US006470842B2

(12) United States Patent
Speil

(10) Patent No.: US 6,470,842 B2
(45) Date of Patent: Oct. 29, 2002

(54) LEVER-TYPE CAM FOLLOWER

(75) Inventor: Walter Speil, Ingolstadt (DE)

(73) Assignee: Ina Walzlager Schaeffler oHG (DE)

( * ) Notice: Subject to any disclaimer, the term of this patent is extended or adjusted under 35 U.S.C. 154(b) by 0 days.

(21) Appl. No.: 09/975,610

(22) Filed: Oct. 11, 2001

(65) Prior Publication Data

US 2002/0043233 A1 Apr. 18, 2002

Related U.S. Application Data

(60) Provisional application No. 60/239,741, filed on Oct. 12, 2000.

(51) Int. Cl.[7] ..... F01L 1/18

(52) U.S. Cl. ..... 123/90.41; 123/90.39; 123/90.42; 123/90.43; 74/559; 29/888.2

(58) Field of Search ..... 123/90.39, 90.41, 123/90.42, 90.43; 74/559; 29/888.2

(56) References Cited

U.S. PATENT DOCUMENTS 2,385,309 A * 9/1945 Spencer ..... 123/90.36
6,138,626 A * 10/2000 Speil ..... 123/90.39
6,273,044 B1 * 8/2001 Engelhardt et al. ..... 123/90.41

* cited by examiner

*Primary Examiner*—Thomas Denion
*Assistant Examiner*—Ching Chang
(74) *Attorney, Agent, or Firm*—Bierman, Muserlian and Lucas

(57) ABSTRACT

A lever-type cam follower (1) of a thin-walled material like sheet metal is proposed. It has a simply structured valve stem guidance in the region of one of its ends (5). The guidance comprises a separate securing element (6) with a basically U-shaped cross-section. A web (9) of the securing element (6) bears against a crossbeam (3) of the cam follower (1) and possesses an opening (11), for example punched, for receiving a valve stem.

11 Claims, 1 Drawing Sheet

LEVER-TYPE CAM FOLLOWER

This application is a non-provisional application of provisional application Ser. No. 60/239,741 filed Oct. 12, 2000.

FIELD OF THE INVENTION

The invention concerns a lever-type cam follower made of thin-walled material like sheet metal, particularly for a valve train of an internal combustion engine, comprising two parallel side walls connected by a crossbeam, an underside of the crossbeam having at one end, a separate securing element comprising two cheeks that are parallel to the side walls for laterally guiding a gas exchange valve the crossbeam comprising an aperture having a crossbar oriented toward the securing element.

BACKGROUND OF THE INVENTION

DE-OS 197 30 201 discloses a cam follower of the pre-cited type that is considered to be generic. This cam follower is likewise made of a sheet metal and possesses at one end, a separate securing element for a lateral guidance of a gas exchange valve. This securing element is configured as a U-like clip which is placed with its crossbar over side walls of the cam follower. A drawback of this prior art is that for guiding the securing element, the side walls of the cam follower are recessed. On the one hand, this weakens the cam follower in this region and on the other hand, manufacturing work and costs are unnecessarily increased.

U.S. Pat. No. 5,016,582 discloses a sheet metal cam follower of a related type whose valve stem support is made on one end by a complex bending design. Due to the doubling of the cam follower resulting from bending, on the one hand, the mass moment of inertia of the cam follower is unnecessarily increased. On the other hand, a relatively great amount of manufacturing work is required for obtaining the aforesaid doubling which is accompanied by the risk of crack formation and the like.

OBJECT OF THE INVENTION

The object of the invention is therefore to create a cam follower of the pre-cited type in which the mentioned drawbacks are eliminated by simple means.

SUMMARY OF THE INVENTION

The invention relates to a lever-type cam follower (1) made of thin-walled material like sheet metal, particularly for a valve train of an internal combustion engine, comprising two parallel side walls (2) connected by a crossbeam (3), an underside (10) of the crossbeam (3) having at one end (5), a separate securing element (6) comprising two cheeks (16) that are parallel to the side walls (2) for laterally guiding a gas exchange valve, the crossbeam (3) comprising an aperture (13) having a crossbar (12) oriented toward the securing element (6), wherein the securing element (6) has a U-like geometry in which a web (9) that connects opposing legs (7, 8) of the securing element (6) bears against the underside (10) of the crossbeam (3) and comprises an opening (11) in which the gas exchange valve can be guided, the cheeks (16) are formed on the opening (11), and as viewed in a longitudinal direction of the cam follower (1), the legs (7, 8) are situated behind one another, one leg (7) extending into the aperture (13) is retained on the crossbar (12) and the other leg (8) is retained in the region of an end (14) of the cam follower (1) on the one end (5).

According to this claim, the securing element has a U-like geometry in which a web that connects opposing legs of the securing element bears against the underside of the crossbeam and comprises an opening in which the gas exchange valve can be guided, the cheeks are formed on the opening, and as viewed in a longitudinal direction of the cam follower, the legs are situated behind one another, one leg extending into the aperture is retained on the crossbar and the other leg is retained in the region of an end of the cam follower on the one end.

Further advantageous features of the invention are the subject matter of the subclaims each of which can contain independently patentable measures in itself or in combination with others.

The securing element of the invention enables cam followers with prior art configurations to be used. It must be noted that there is no weakening of the cross-section of the cam follower in the region of the securing element. The securing element is simple and cheap to manufacture and it can be fixed through its legs on an upper surface of the crossbeam for example by clipping, bending, snapping or crimping. The lateral guidance on the gas exchange valve is realized solely by edges of an opening punched out of the web of the securing element.

If an additional guide height is desired, according to a further feature of the invention, the region of the lateral cheeks of the opening can be raised compared to the height of the opening itself. The cheeks can then be made, for example, out of the material that was originally a part of the opening.

A securing element, particularly rigid in the region of guidance, is obtained if the entire opening is formed with an extension extending away from the web, which extension then comprises the cheeks. Advantageously, this extension has the same height around its entire periphery.

In a further preferred configuration of the invention, at least one of the legs of the securing element comprises a window into which the crossbeam extends. In this way, the securing element in its turn is very simply fixed on the crossbeam. It is, however, also conceivable and provided for by the invention to bend at least one of the legs in the manner of a hinge onto the upper surface of the crossbeam.

If the securing element is to be connected to the crossbar by crimping the legs, it can be given a soft configuration at least in its leg region so that crimping can be effected in an uncomplicated manner. At the other endd, the securing element can also have a springy configuration which enables it to be connected to the crossbeam in a simple manner by clipping.

The U-profile of the cam follower proposed in a further sub-claim, in which an underside of the crossbeam of the cam follower is oriented away from the side walls, results in a particularly rigid configuration of the cam follower. However, an inverted U-profile, an H-profile or the like is also conceivable. The scope of the invention likewise extends to a cam follower that is not made of steel sheet but of a light-weight material or a composite material, or of cast metal and the like.

The roller in the aperture of the crossbeam that is held in the side walls of the cam follower minimizes work consumed by friction in the valve train, but a sliding contact is also conceivable.

It is also a subject matter of the invention to make a gap between the roller and the adjacent leg of the securing element smaller than (or, at the most, of equal dimension to) a thickness of the leg. This creates an excellent security against a possible tendency of the securing element to jump off during operation. At all events, the gap must be so small that, if an undesired jumping-off does take place (caused by an acceleration jerk etc.), the leg is retained by positive engagement on the roller.

Advantageously, the cam follower is configured as a finger lever that is mounted on its other end on a support element. However, the invention applies to all kinds of lever-type cam followers having a securing element that may be used in a valve train of an internal combustion engine and for which it is desired to realize an extremely simply structured guidance on at least one gas exchange valve.

BRIEF DESCRIPTION OF THE DRAWINGS

The invention will now be described more closely with reference to the drawings in which.

DETAILED DESCRIPTION OF THE DRAWINGS

Figure 1:
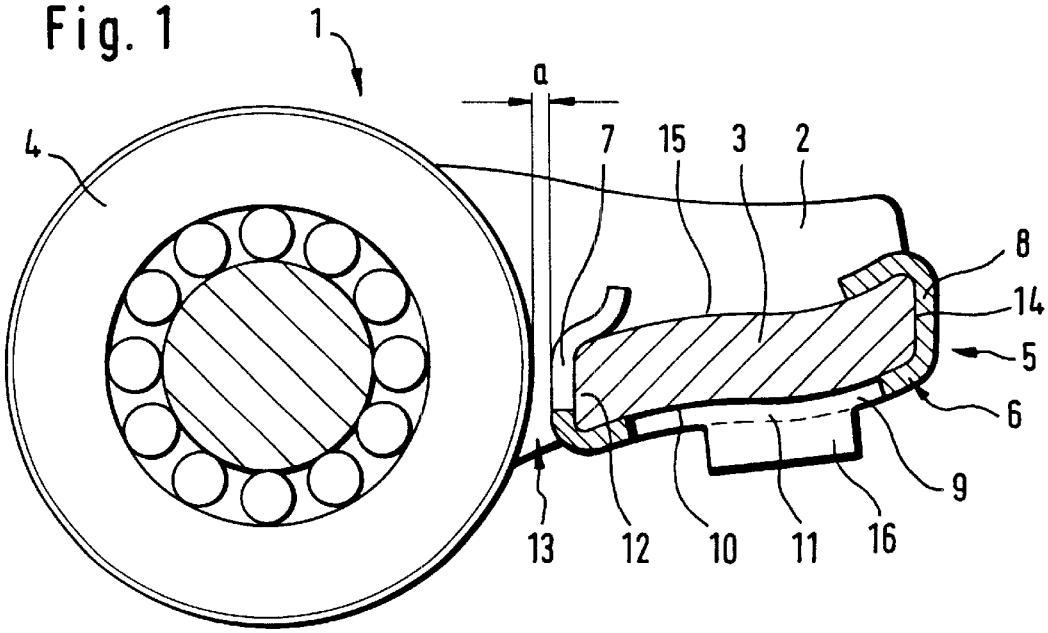
FIG. 1 is a partial longitudinal section through a cam follower of the invention taken in the region of the securing element.

FIG. 1 shows a partial longitudinal cross-section through a cam follower 1 of the invention. The cam follower 1 comprises two parallel side walls 2 that are connected to each other by a crossbeam 3. As viewed in cross-section, the side walls 2 and the crossbeam 3 form a U-shaped profile.

The cam follower is configured as a finger lever in whose central region a roller 4 is mounted in the side walls 2 for a low-friction cam contact. In the region of one of its ends 5, the cam follower 1 comprises a separate and thin-walled securing element 6. Through this securing element 6, that will be described more closely below, a lateral guidance of the cam follower 1 on a gas exchange valve, not illustrated, is achieved.

The securing element 6 is generally U-shaped and comprises two opposing legs 7, 8 that are connected to each other by a web 9. The web 9 bears against an underside 10 of the crossbeam 3. According to the invention, the web 9 has an opening 11 through which the guidance on the gas exchange valve is advantageously realized.

The leg 7 oriented toward the roller 4 bears against a crossbar 12 of an already existing aperture 13 of the crossbeam 3, into which aperture 13 the roller 4 extends. The leg 8, in contrast, is guided around an end 14 of the cam follower 1 in the region of the one end 5 and is bent onto an upper surface 15 of the crossbeam 3 for positional fixing. The leg 7 is connected to the crossbeam 3, for example, likewise by the aforesaid fixing measure. However, clipped connections and the like are also conceivable (see also Claims and discussion of advantages relating to the Claims). Depending on the choice of the kind of connection of the securing element 6 to the crossbeam 3 through its legs 7, 8, the material may be a springy material or a soft steel, for example.

As a person skilled in the art can readily see from the figures, the cam follower 1 is guided on an end of a valve stem of a gas exchange valve by the edges of the opening 11. The important thing here is the lateral guidance, so that it is proposed to increase the guide height by forming cheeks 16 laterally of the gas exchange valve, i.e., parallel to the longitudinal extent of the cam follower 1. These cheeks 16 can be formed, for example, from the material of the opening 11.

The illustrated gap (a) between the roller (4) and the leg (7) is preferably chosen to be smaller than a thickness of the leg (7). This prevents a springing-off of the securing element (6) during operation ( see also discussion of advantages relating to the Claims). During an assembly of the cam follower (1), at first, the securing element (6) is fixed, and the roller (4) is then connected to the side walls 2 of the cam follower 1.

Figure 2:
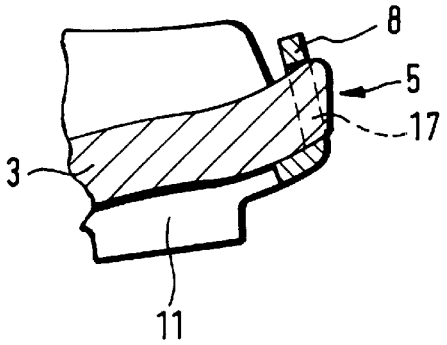
FIGS. 2, 3 show advantageous forms of fixing the securing element on the crossbeam.

FIG. 2 discloses that in the region of the end 5, the leg 8 can also comprise a window 17 in which an end of the crossbeam 3 extends. This is an alternative form of fixing the securing element 6 on the crossbeam 3.

Figure 3:
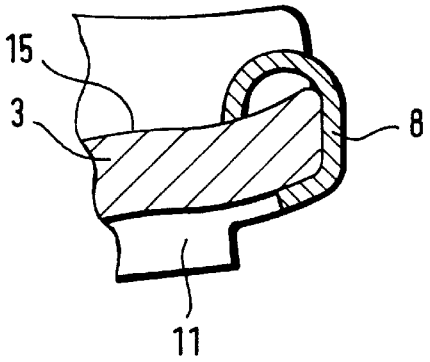

FIG. 3 shows that the leg 8 may be bent onto the upper surface 15 of the crossbeam 3 for positional fixing, for instance, in the manner of a hinge.

Figure 4:
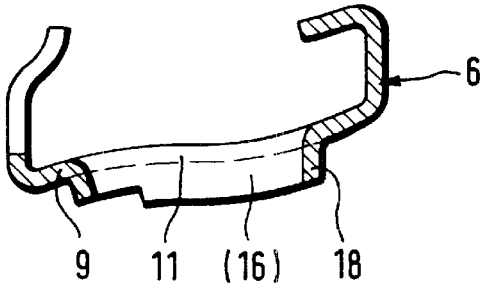
FIG. 4 shows an alternative configuration of the securing element.

Finally, FIG. 4 discloses that the entire opening 11 of the web 9 can be configured with an extension 18 extending away therefrom. Thus, this extension 18 also possesses the cheeks 16. The advantage of this configuration is that the securing element 6 has a particularly rigid design in its guiding region.

List of Reference Numerals

1 Cam follower
2 Side wall
3 Crossbeam
4 Roller
5 One end
6 Securing element
7 Leg
8 Leg
9 Web
10 Underside
11 Opening
12 Crossbar
13 Aperture
14 End face
15 Upper surface
16 Cheek
17 Window
18 Extension
a Gap

What is claimed is:

1. A lever-type cam follower (1) made of thin-walled material like sheet metal, for a valve train of an internal combustion engine, comprising two parallel side walls (2) connected by a crossbeam (3), an underside (10) of the crossbeam (3) having at one end (5), a separate securing element (6) comprising two cheeks (16) that are parallel to the side walls (2) for laterally guiding a gas exchange valve, the crossbeam (3) comprising an aperture (13) having a crossbar (12) oriented toward the securing element (6), wherein the securing element (6) has a U-like geometry in which a web (9) that connects opposing legs (7, 8) of the securing element (6) bears against the underside (10) of the crossbeam (3) and comprises an opening (11) in which the gas exchange valve can be guided, the cheeks (16) are formed on the opening (11), and as viewed in a longitudinal direction of the cam follower (1), the legs (7, 8) are situated behind one another, one leg (7) extending into the aperture (13) is retained on the crossbar (12) and the other leg (8) is retained in the region of an end (14) of the cam follower (1) on the one end (5).

2. A cam follower according to claim 1, characterized in that the cheeks (16) have a greater height than the web (9) of the securing element (6).

3. A cam follower according to claim 2, characterized in that the cheeks (16) are cut and bent out of the web (9) and thus at least partially form the opening (11).

4. A cam follower according to claim 1, characterized in that the entire opening (11) of the web (9) is formed by an extension (18) extending away from the web (9).

5. A cam follower according to claim 1, characterized in that at least one of the legs (7, 8). of the securing element (6) is bent, snapped, crimped or clipped in direction of, or onto an upper surface (15) of the crossbeam (3).

6. A cam follower according to claim 1, characterized in that at least one of the legs (7, 8) of the securing element (6) comprises a window (17) into which the crossbeam (3) extends.

7. A cam follower according to claim 1, characterized in that a roller (4) that is retained in the side walls (2) extends in the aperture (13) of the crossbeam (3).

8. A cam follower according to claim 7, characterized in that a gap (a) between the leg (7) of the securing element (6) and the roller (4) is smaller than a thickness of the securing element (6) at least on this leg (7).

9. A cam follower according to claim 1 wherein the side walls (2) form a U-profile with the crossbeam (3), the underside (10) of the crossbeam (3) being oriented away from the side walls (2).

10. A cam follower according to claim 1, characterized in that the securing element (6) is made of a light-weight material such as thin-walled sheet metal/spring sheet or of a plastic or a plastic-metal composite material.

11. A cam follower according to claim 1, characterized in that the cam follower (1) is configured as a finger lever that is adapted to be mounted at its other end on a support element.

* * * * *